United States Patent [19]

Casteel

[11] 4,336,975

[45] Jun. 29, 1982

[54] AUTOMOTIVE ELECTRICAL HARNESS

[76] Inventor: Ronald C. Casteel, 2891 Glen Echo Dr., Lizella, Ga. 31052

[21] Appl. No.: 134,421

[22] Filed: Mar. 27, 1980

[51] Int. Cl.[3] ..... H01R 11/32

[52] U.S. Cl. ..... 339/28; 339/119 R

[58] Field of Search ..... 339/29, 29, 119, 147 C, 339/157 C

[56] References Cited

U.S. PATENT DOCUMENTS 2,481,181 9/1949 Walter ..... 339/157 C 3,647,170 3/1972 Beeker et al. ..... 339/28

FOREIGN PATENT DOCUMENTS 982672 12/1976 Canada ..... 339/119 R

*Primary Examiner*—Joseph H. McGlynn

*Attorney, Agent, or Firm*—Diller, Ramik & Wight

[57] ABSTRACT

This disclosure relates to a harness for a portion of an automotive electrical system and, more particularly, to a harness which is adapted to be clamped to a solenoid carried to an automotive starter such that the starter can be "dropped" or removed from the engine, along with the solenoid, and once the starter is repaired or replaced, the electrical harness of this invention is utilized to connect electrical conductors to the starter solenoid through a quick disconnect connector whereby at any future time that the starter need be again removed and/or replaced, the quick disconnect coupler is simply uncoupled and the starter, the solenoid and the associated harness are bodily removed, repaired and bodily replaced, thus making the task of removing and replacing starters far less cumbersome and much more rapid than has been accomplished in the past.

11 Claims, 5 Drawing Figures

66
10
63
63
11
62
24
25
71
14
12
26
16
15
24
25
26
32
33
31
34
37
35
36
46
47
45
44
48
50
49
55

66
65
63
10
72
71
12
25
24
26
11
22
22
23
13
16
15
19
18
14
17
25
24
34
26
44
48
49
50
55

AUTOMOTIVE ELECTRICAL HARNESS

A primary object of this invention is to provide a novel electrical harness particularly adapted for utilization with the solenoid and starter of an associated automobile. When a starter and the solenoid, generally carried thereby, are installed in an automobile, they generally occupy a position at which it is relatively difficult to disconnect the conventional conductors or wires which are connected to the solenoid terminals (generally three in number). Generally, the solenoids have a central generally axially disposed threaded conductor and two conductors outboard thereof with the central or center conductor being the current supply for the solenoid and connected thereto is a wire which is secured in place by a relatively small threaded nut (11/32 inch). The outboard threaded terminals are also connected to wires by nuts, but the central nut is virtually impossible to remove with ease and is just as impossible to replace. These difficulties are compounded when the starter and the solenoid carried thereby are positioned in relatively inaccessible areas adjacent the automobile engine, and particularly at areas where during the connection and disconnection of the wires to the solenoid terminals, the latter can not be seen visually and one must remove and replace the connecting nuts by "feel." This task renders what might otherwise be a relatively simple operation highly difficult from the standpoint of the time involved and, thus, the cost is appropriately increased.

With the foregoing in mind, the present invention overcomes the difficulties described by providing an integral one-piece harness molded from polymeric or copolymeric plastic material, such as polyethylene, which has a pair of generally arcuate arms for externally embracing the outer cylindrical body of a solenoid and an elongated body through which pass and are captively held one or more (normally three) wires or electrical conductors, each having opposite terminal ends with three of the ends being adapted to be connected to the terminals of the solenoid and the opposite three terminal ends having a quick disconnect coupler associated therewith such that upon the disconnection of the latter from the main circuitry of the automotive electrical system, the starter and its associated solenoid can be removed and replaced with relative ease, convenience and speed.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
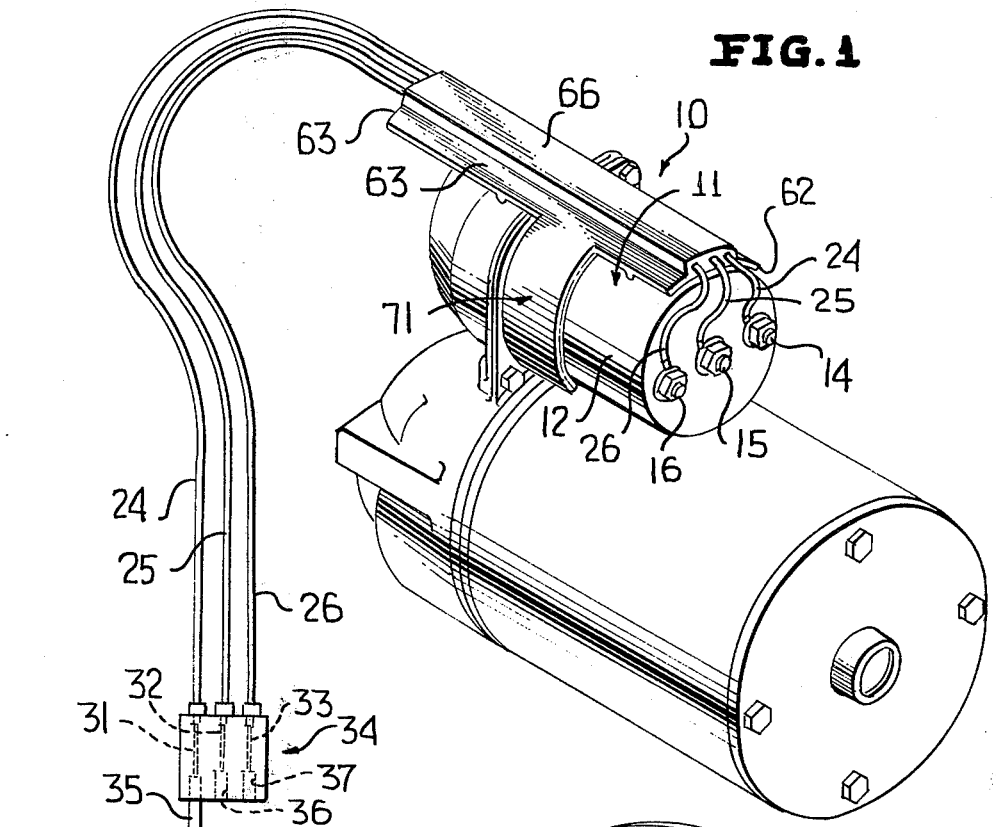
FIG. 1 is a perspective view generally from the side and above an automotive starter, a generally cylindrical starter solenoid carried by the starter, and a harness of this invention held to the solenoid by resilient clamping arms with wires connected at one end to the solenoid and having at an opposite end a quick disconnect coupler.
Figure 2:
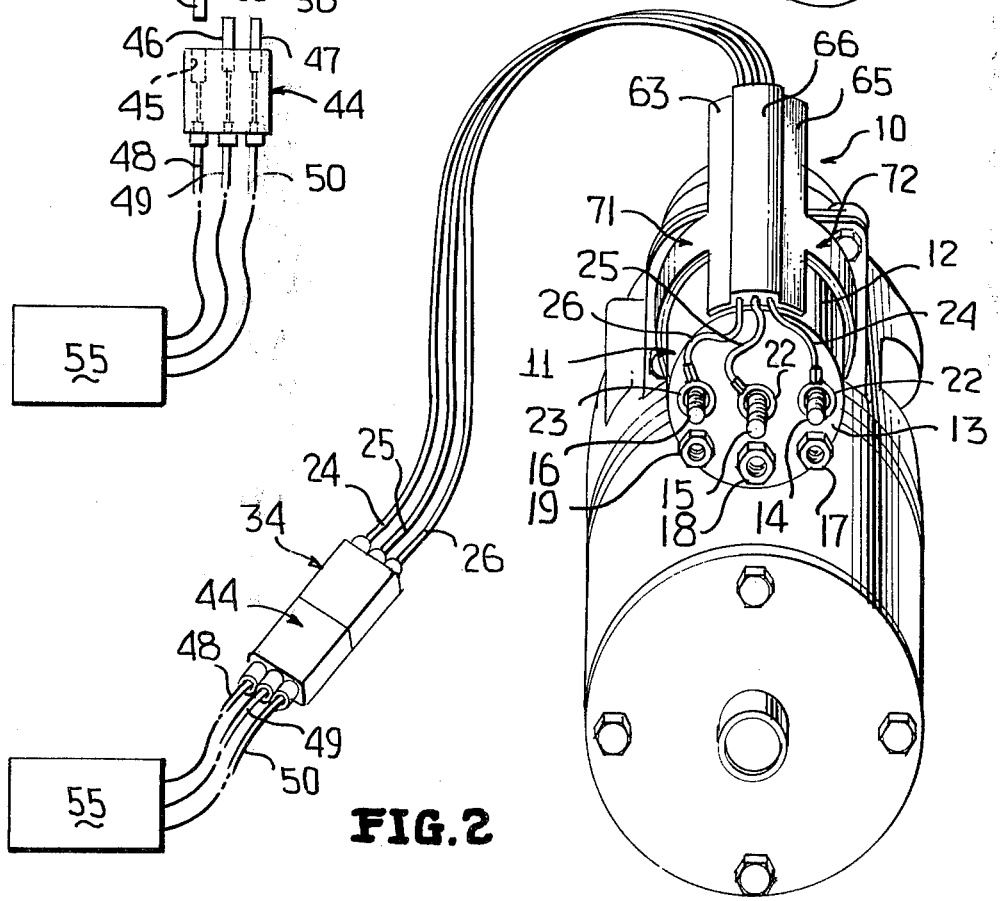
FIG. 2 is an end perspective view of the starter, solenoid and harness of FIG. 1, and illustrates more clearly the manner in which the ends of three wires are connected to threaded posts of the solenoid by appropriate threaded nuts and with the quick disconnect coupler being connected as it would be in operation in association with an automobile engine.

Reference is first made to FIGS. 1 and 2 of the drawings which illustrate a novel harness of this invention which is generally designated by the reference numeral 10. The harness 10 is shown associated with and being carried by a generally cylindrical solenoid 11 having a generally cylindrical body 12, an end wall 13, and three threaded electrical conductors or terminals 14 through 16 projecting generally axially therefrom with the conductor or terminal 15 being centermost and generally coincident with the solenoid axis and the conductors or terminals 14, 16 being each outboard of the central terminal 15. Appropriately threaded nuts 17 through 19 are threaded upon the conductors or terminals 14 through 16, respectively, to hold in place respective conductive end terminals 21 through 23 of respective conductors or wires 24 through 26 which in part defines the harness 10 and will be described more fully hereinafter. However, for the moment it need be noted that the conductors or wires 24 through 26 may or may not be individually insulated and all are embedded in and pass through a central elongated body or body portion 27 (FIG. 4) of the harness 10 and have respective ends 31 through 33 which are opposite from the ends 21 through 23 and are connected to a quick disconnect coupling 34 which includes a male conductive plug 35 associated with the wire 31 and female conductive sockets 36 and 37 connected to the respective conductors 32 and 33. The quick disconnect coupling 34 is, of course, adapted to be connected to and disconnected from another quick disconnect coupling 44 having a female socket 45 which receives the plug 35 and plug conductors 46, 47 which are received in the respective female sockets 36, 37 of the quick disconnect coupling 34. The female socket 45 and the plugs 46, 47 are, of course, electrically connected to wires 48 through 50, respectively, which are part of the overall automobile electrical system 55 which is shown schematically in FIGS. 1 and 2 of the drawings. It is to be particularly noted that upon the disconnecting of the conducting portions 35 through 37 from the respective conductive portions 45 through 47, the harness 10 can be completely disassociated from the overall automobile electrical system 55 and, therefore, the harness 10, while still connected to the solenoid 11 which is in turn connected to a starter 20, can be bodily removed from and/or replaced relative to an automotive engine.

Figure 3:
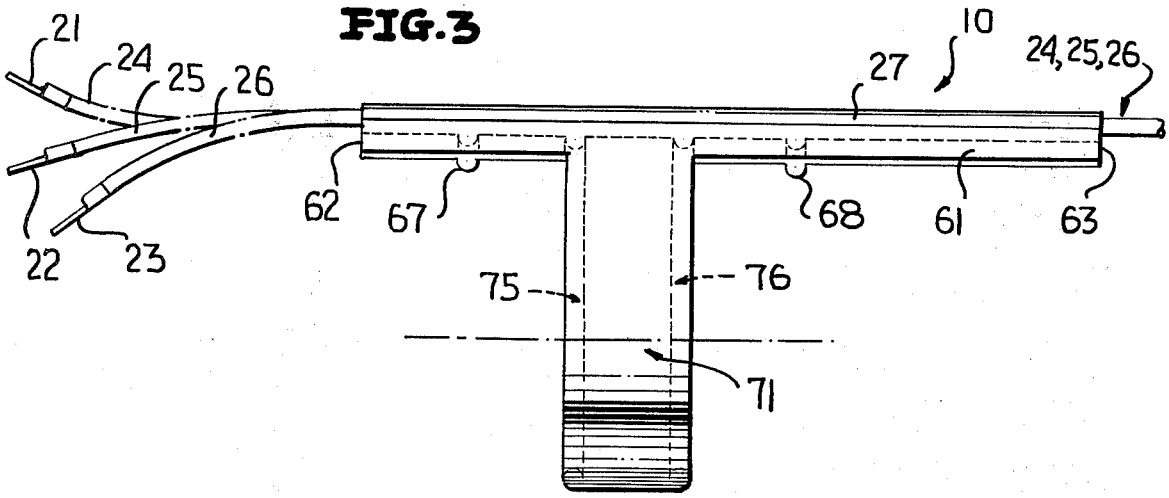
FIG. 3 is a side perspective view of the harness of this invention, and illustrates details of one of the arcuate clamping arms and an elongated body thereof through which pass three wires or electrical conductors.
Figure 4:
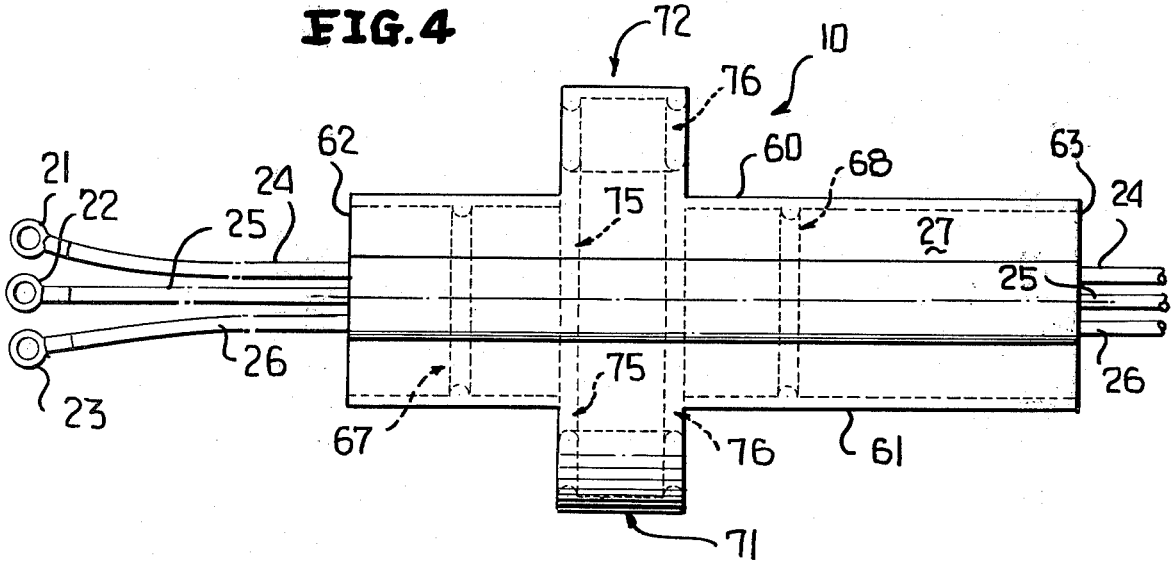
FIG. 4 is a top plan view of the harness of FIG. 3, and illustrates more clearly the three wires passing through an elongated body portion of the harness.
Figure 5:
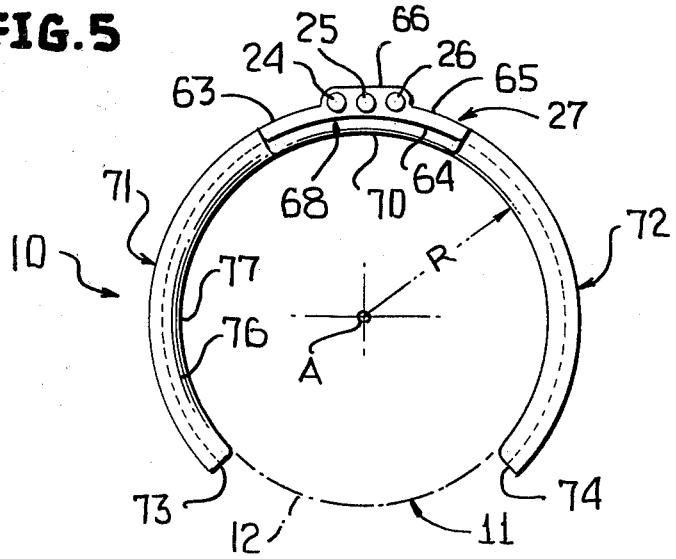
FIG. 5 is an end view of the harness of FIGS. 3 and 4, and more clearly illustrates the three conductors passing through the elongated body of the harness and the arcuate configuration of the clamping arms.

Reference is now made specifically to FIGS. 3 through 5 of the drawings wherein is best illustrated details of the overall harness 10 including the elongated body portion 27 which is generally defined by longitudinal sides 60, 61 which are generally parallel to each other and opposite ends 62, 63 which are slightly curved, as is most evident from FIG. 5, thus imparting to the overall elongated body portion 27 an innermost concave surface 64 and an upper convex surface 65 centrally of which there is a raised portion 66 through which pass the wires or conductors 14 through 16, as is again most apparent from FIG. 5. The under side of the elongated body portion 27 is reinforced by two arcuate downwardly facing reinforcing ribs 67, 68 which likewise define concave surfaces which open downwardly with the concave surface of the rib 68 being generally designated by the reference numeral 70. The surface 70 is generated by a radius R emanating from an axis of generation A with the radius R being slightly less than the diameter of the cylinder body 12 of the solenoid 11 such that the harness will be in intimate external engagement with the solenoid 11, as is readily apparent from FIGS. 1 and 2 and can be readily visualized from FIG. 5 in which the solenoid 11 has been illustrated with its body 12 in phantom outline.

The harness 10 further includes means in the form of a pair of resilient clamping arms 71, 72 having respective terminal ends 73, 74 and inwardly directed reinforcing ribs 75, 76 which have innermost concave surfaces with a surface 77 of the ribs 76 being exemplary and being generated again by the radius R from the axis of generation A. Thus, the surface 77 of the rib 76 and a like surface (unnumbered) of the rib 75 and the corresponding surfaces 70 of the rib 68 and the like surface (unnumbered) associated with the rib 67 all correspond generally in curvature to that of the surface 12 of the solenoid 11 (FIG. 5) such that the resilient clamping force of the arms 71, 72 hold the harness 10 securely to the solenoid 11.

The ends 73, 74 (FIG. 5) of the harness 10 are spaced from each other both when connected to the solenoid 11 (FIGS. 1, 2 and 5) and when unconnected therefrom. When unconnected from the solenoid 11, the arms will move slightly toward each other from the position shown in FIG. 5 under the inherent resilience of the material forming the harness 10, and the same ends 73, 74 can be spread away from each other at a distance corresponding to twice the radius R so that the arms 71, 72 can be snap engaged upon the cylindrical surface 12 of the solenoid 11. Obviously, the harness 10 can be removed from the surface 12 of the solenoid 11 by simply pulling the same therefrom whereupon the arms 71, 72 temporarily spread away from each other and once removed obviously rebound to their original position.

As was earlier noted and is most apparent from FIGS. 1 and 2, it can be readily appreciated that in a conventional installation the wires 48 through 50 emanating from the automobile electrical system 55 are directly connected to the terminals 14 through 16, respectively, of the solenoid 11. Thus, to remove these wires 48 through 50 in the absence, of course, of the harness 10 of this invention, one would necessarily have to attempt to remove the nuts 17 through 19 and likewise reassemble these nuts to the respective terminals 14 through 16 upon the reinstallation of the starter and solenoid. This is, of course, difficult, time consuming, etc., and in lieu thereof if one desires to drop or remove the starter 20, in keeping with the present invention, the quick disconnect couplings 34 and 44 are simply disconnected, as is clearly illustrated in FIG. 1, and the starter 20, the solenoid 11, and the harness 10 are bodily removed from the automobile. Thereafter, any repairs and/or replacements necessary with respect to the starter can be made, the various components reassembled as might need be, and reinstalled by again merely recoupling the quick disconnect couplings 34, 44. It should be noted that during the entire operation just described, the terminals 21 through 23 need not be manipulated in any fashion relative to the terminals 14 through 16 of the solenoid 11, nor need the nuts 17 through 19 be manipulated during either removal or replacement operations. Thus, by the utilization of this invention, one need simply disconnect the plug 44 from the plug 43 and the remaining harness 10, solenoid 11 and starter 20 (FIG. 1) can be removed from and reapplied to an automotive engine with relative ease.

Although only a preferred embodiment of the invention has been specifically illustrated and described herein, it is to be understood that minor variations may be made in the apparatus without departing from the spirit and scope of the invention, as defined in the appended claims.

I claim:

1. The combination of an electric powered automotive engine starter, an automotive engine starter electrical solenoid, an automotive electrical power source and a harness, said harness being carried by said electrical solenoid and including a body, said body including means for securing said harness to said automotive engine starter solenoid, at least one electrical conductor carried by said body and terminating in opposite free end portions, one of said free end portions defining a first electrically conductive terminal, said first electrically conductive terminal being connected to an associated electrical terminal of said automotive engine starter solenoid, another of said free end portions defining a second electrically conductive terminal, said second electrically conductive terminal being of the quick disconnect type, and said first quick disconnect conductive terminal being electrically connected to said automotive electrical power source.

2. The combination as defined in claim 1 wherein said securing means includes a generally concavely curved clamping surface adapted to engage an exterior convex surface of said automotive engine starter solenoid, said concavely curved clamping surface being defined by an axis of generation, and said axis being in spaced parallel relationship to at least that portion of said one electrical conductor which is secured to said body.

3. The combination as defined in claim 1 wherein said body includes a generally elongated portion medially of which is disposed said securing means, and said electrical conductor is embedded within said elongated portion in generally parallel relationship to a longitudinal axis of said elongated portion.

4. The combination as defined in claim 1 wherein said first electrically conductive terminal is of a nonquick disconnect type.

5. The combination as defined in claim 1 wherein said solenoid includes an axis disposed in generally parallel relationship to at least a portion of said electrical conductor axis and the longitudinal axis of said elongated body.

6. The combination as defined in claim 1 wherein said body includes a generally elongated portion medially of which is disposed said securing means, and said electrical conductor is embedded within said elongated portion in generally parallel relationship to a longitudinal axis of said elongated portion.

7. The combination as defined in claim 1 wherein said solenoid and starter have axes disposed generally parallel to each other and to said axis of generation.

8. The combination as defined in claim 1 wherein said securing means includes a generally concavely curved clamping surface adapted to engage an exterior convex surface of said automotive engine starter solenoid.

9. The combination as defined in claim 8 wherein said electrical solenoid has an axis disposed in generally parallel relationship to at least a portion of the axis of said conductor.

10. The combination as defined in claim 1 wherein said body is elongated and has opposite end portions, said body is formed of synthetic plastic material, said securing means is medially of said body opposite ends, said securing means includes a pair of resilient clamping arms defining a concavely curved clamping surface adapted to snugly clampingly engage a convex exterior surface of said solenoid, said electrical conductor spans said elongated body with said electrical conductor being disposed with its axis in generally parallel relationship to the longitudinal axis of said elongated body, and said concavely curved clamping surface being defined by an axis of generation disposed in spaced parallel relationship to said longitudinal axis and said electrical conductor axis.

11. The combination as defined in claim 10 wherein said solenoid includes an axis disposed in generally parallel relationship to at least a portion of said electrical conductor axis and the longitudinal axis of said elongated body.

* * * * *